US009194636B2

(12) United States Patent
McAninch

(10) Patent No.: US 9,194,636 B2
(45) Date of Patent: Nov. 24, 2015

(54) HANDGUN CHARGING SYSTEM

(75) Inventor: Chris McAninch, Grimes, IA (US)

(73) Assignee: GUNSANDMORE.INFO LLC, Grimes, IA (US)

( * ) Notice: Subject to any disclaimer, the term of this patent is extended or adjusted under 35 U.S.C. 154(b) by 231 days.

(21) Appl. No.: 13/433,837

(22) Filed: Mar. 29, 2012

(65) Prior Publication Data

US 2013/0255478 A1 Oct. 3, 2013

(51) Int. Cl.

| | |
|---|---|
| ***F41A 7/02*** | (2006.01) |
| ***F41A 7/00*** | (2006.01) |
| ***F41A 19/39*** | (2006.01) |
| ***F41A 19/52*** | (2006.01) |
| ***F41C 27/00*** | (2006.01) |

(52) U.S. Cl.

CPC . *F41A 7/00* (2013.01); *F41A 19/39* (2013.01); *F41A 19/52* (2013.01); *F41C 27/00* (2013.01)

(58) Field of Classification Search

USPC ..... 89/1.4; 42/90, 94, 97, 99, 106, 124–128

See application file for complete search history.

(56) References Cited

U.S. PATENT DOCUMENTS

| | | | | |
|---|---|---|---|---|
| 3,763,587 | A * | 10/1973 | Firmalino | 42/106 |
| 4,043,065 | A | 8/1977 | Musgrave | |
| 4,055,015 | A | 10/1977 | Musgrave | |
| 4,138,044 | A | 2/1979 | Musgrave | |
| 4,298,150 | A | 11/1981 | Seldeen | |
| 4,467,698 | A * | 8/1984 | Perrine | 89/190 |
| 4,823,671 | A * | 4/1989 | Buryta | 89/1.4 |
| 6,318,014 | B1 * | 11/2001 | Porter | 42/72 |
| 6,493,978 | B1 * | 12/2002 | Perkins | 42/70.11 |
| 6,561,073 | B1 * | 5/2003 | Hogmoe | 89/1.42 |
| 8,312,803 | B2 * | 11/2012 | Oz | 89/1.4 |
| 2011/0154710 | A1 * | 6/2011 | Hatfield | 42/90 |
| 2011/0283587 | A1 * | 11/2011 | Sharp et al. | 42/90 |
| 2015/0184959 | A1 * | 7/2015 | Parnell | F41A 3/72 89/1.4 |

* cited by examiner

*Primary Examiner* — Stephen M Johnson

*Assistant Examiner* — Benjamin Gomberg

(74) *Attorney, Agent, or Firm* — Brett J. Trout, P.C.

(57) ABSTRACT

A system and method for charging a handgun. A body is frictionally fit over the slide of a handgun and placed against a hard surface. The grip of the handgun is depressed, thereby retracting the slide and ejecting any spent cartridge. As pressure on the grip is released, the recoil spring forces the slide forward relative to the frame of the handgun, stripping a cartridge from the magazine and inserting the cartridge into the barrel of the handgun. The body is then removed from the slide and the handgun may be fired. The body is configured to fit into frictional mating engagement with the slide and allow the barrel of the handgun to extend into a cavity in the body as the slide is retracted relative to the frame of the handgun.

9 Claims, 6 Drawing Sheets

HANDGUN CHARGING SYSTEM

TECHNICAL FIELD

The present disclosure relates in general to a system for charging a handgun and, more particularly, to a system for charging a handgun which reduces the amount of lateral gripping force which must be applied to a handgun slide to charge the handgun

BACKGROUND

Most modern automatic and semi-automatic handguns are operated by moving a slide rearward, exposing a cartridge. When the slide is released, a spring forces the slide forward, catching the rear end of the cartridge and pushing the cartridge into the barrel as the spring continues to move the slide forward, until the slide is locked into battery. As a spring is required to move the slide forward and place the cartridge in the barrel, moving the slide rearward against the force of the spring can be difficult. Often, serrations are provided on the sides of the slide to aid a user in gripping the slide as it is moved rearward. Even with serrations, it may be difficult for people with weak hands or other physical limitations to pull the slide sufficiently rearward against the force of the spring to load a cartridge in the barrel.

It is known in the art to attach rings or other items to the slide to allow a user to more easily grip these elements and pull the slide rearward. One drawback associated with such prior art charging devices is that they must be affixed to the slide. This process can not only be time consuming, but may affect the performance of the handgun as the system has weight and disturbs the balance of the handgun during operation.

It is also known in the art to provide charging holsters. Prior art charging holsters provide a system for completely surrounding the handgun and catching the slide so that as a user presses the handgun downward, the holster allows the barrel to extend through a slot in the holster until the slide has retracted sufficiently to allow a cartridge to be captured and inserted into the barrel as the user retracts the handgun from the holster. One drawback associated with such prior art holsters is that the user must wear a holster to charge the handgun. Another drawback associated with such holsters is the proximity of the user's leg to the front of the muzzle during the charging operation. An accidental discharge during the charging operation could cause injury or death if the bullet were to travel into the user's leg.

It is also known to provide a charging socket, such as that described in U.S. Pat. No. 4,043,065. Such devices may be attached to a holster, a steering wheel or the like, to allow a user to position the handgun in the socket, push the handgun forward into the socket, and retract the handgun therefrom. The socket is provided with tapered sides that fully surround and contact the slide of the handgun. The socket is also provided with a slot to allow the barrel to pass therethrough. As the handgun is pushed into the socket, the barrel extends into the specially designed slot and the slide is retracted. When the handgun is removed from the socket, the slide inserts a cartridge into the barrel.

One drawback associated with such prior art systems is the requirement of placing an object in front of the muzzle of a loaded handgun. In the event of an accidental discharge, the close proximity of the device to the muzzle may cause a dangerous ricochet and or destruction of the device, which could splinter and injure the user. Another drawback associated with such prior art devices is the fixed nature of the device on a user's holster, a steering wheel or the like. Given the fixed location of the device, the device is necessarily less portable or convenient.

It would, therefore, be desirable to provide a portable system for assisting users with physical limitations to charge automatic and semi-automatic handguns. It would also be desirable to provide a system that did not require complicated attachment systems to secure the system to the slide of a handgun. It would also be desirable to provide a system that may be easily removed from the slide prior to firing to allow for proper weight distribution and operation of the slide. It would also be desirable to provide a handgun charging system that did not require the user to place the device directly in front of the muzzle before and after charging the handgun.

The difficulties encountered in the prior art heretofore are substantially eliminated by the present disclosure.

SUMMARY OF THE DISCLOSED SUBJECT MATTER

The disclosed subject matter relates to a handgun charging system. A body is provided with a first cavity defining a slide receiver and a second cavity defining a barrel receiver. The body is placed over the slide of a handgun. The body may be placed on a table or other surface as a user depresses the handgun grip downward. The body retains the slide within the slide retainer, allowing the barrel to extend into the barrel receiver. Once the slide has moved sufficiently rearward, the user releases pressure on the handgun grip, allowing the recoil spring to drive the slide forward and load a cartridge into the barrel. Thereafter, the body is removed from the slide and the handgun may be fired.

To unload the handgun, the body is placed over the slide of the handgun. The body is positioned against a hard surface and the user presses against the grip of the handgun until the slide has moved sufficiently rearward to eject the cartridge or a spent casing from the barrel. The user then releases pressure from the grip, allowing the recoil spring to drive the slide forward. The body is then removed from the slide.

BRIEF DESCRIPTION OF THE DRAWINGS

The present invention will now be described, by way of example, with reference to the accompanying drawings in which.

DETAILED DESCRIPTION OF THE DRAWINGS

Figure 1:
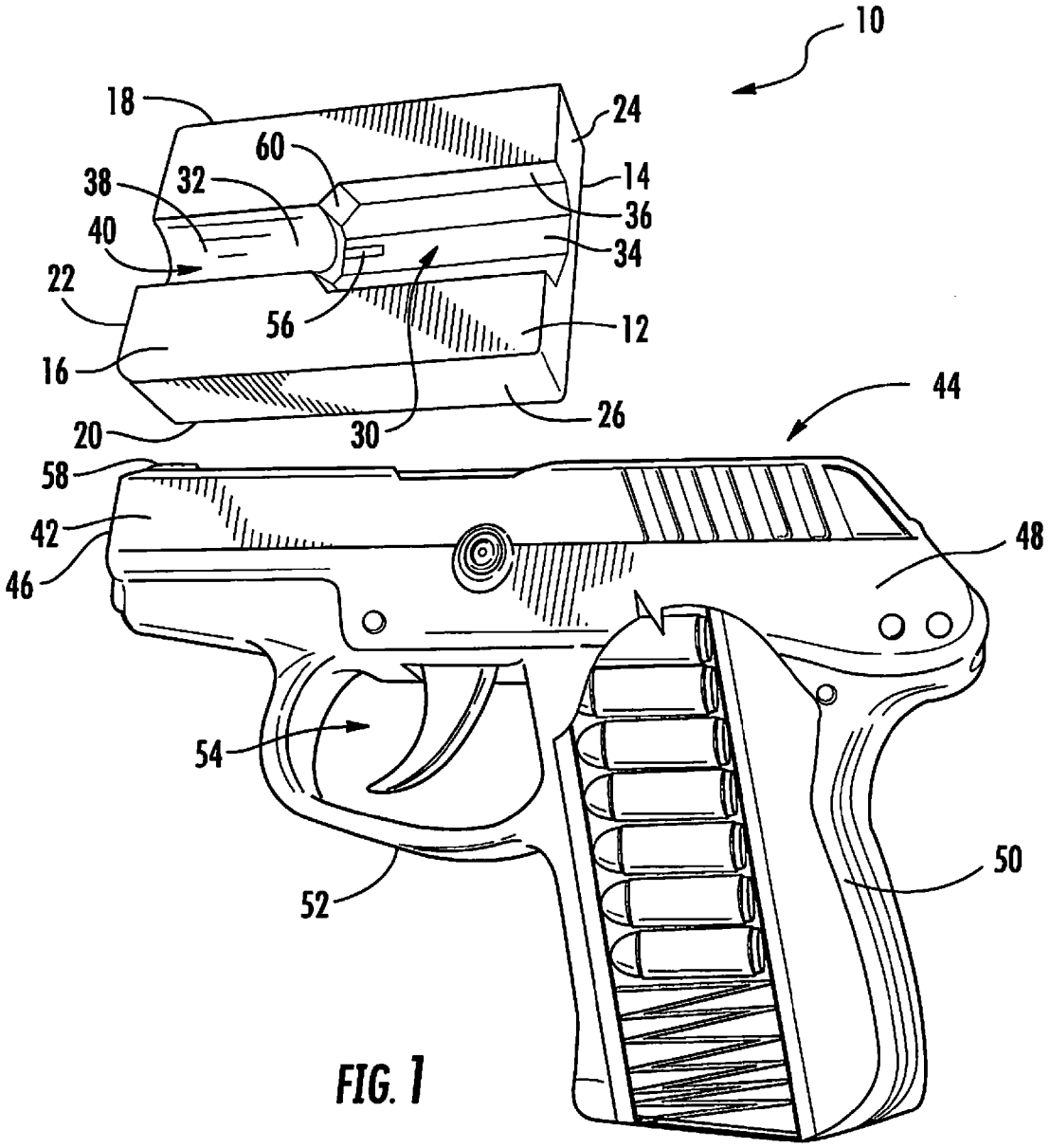
FIG. 1 illustrates a side perspective view of the handgun charging system of the present invention being placed on a handgun.
Figure 2:
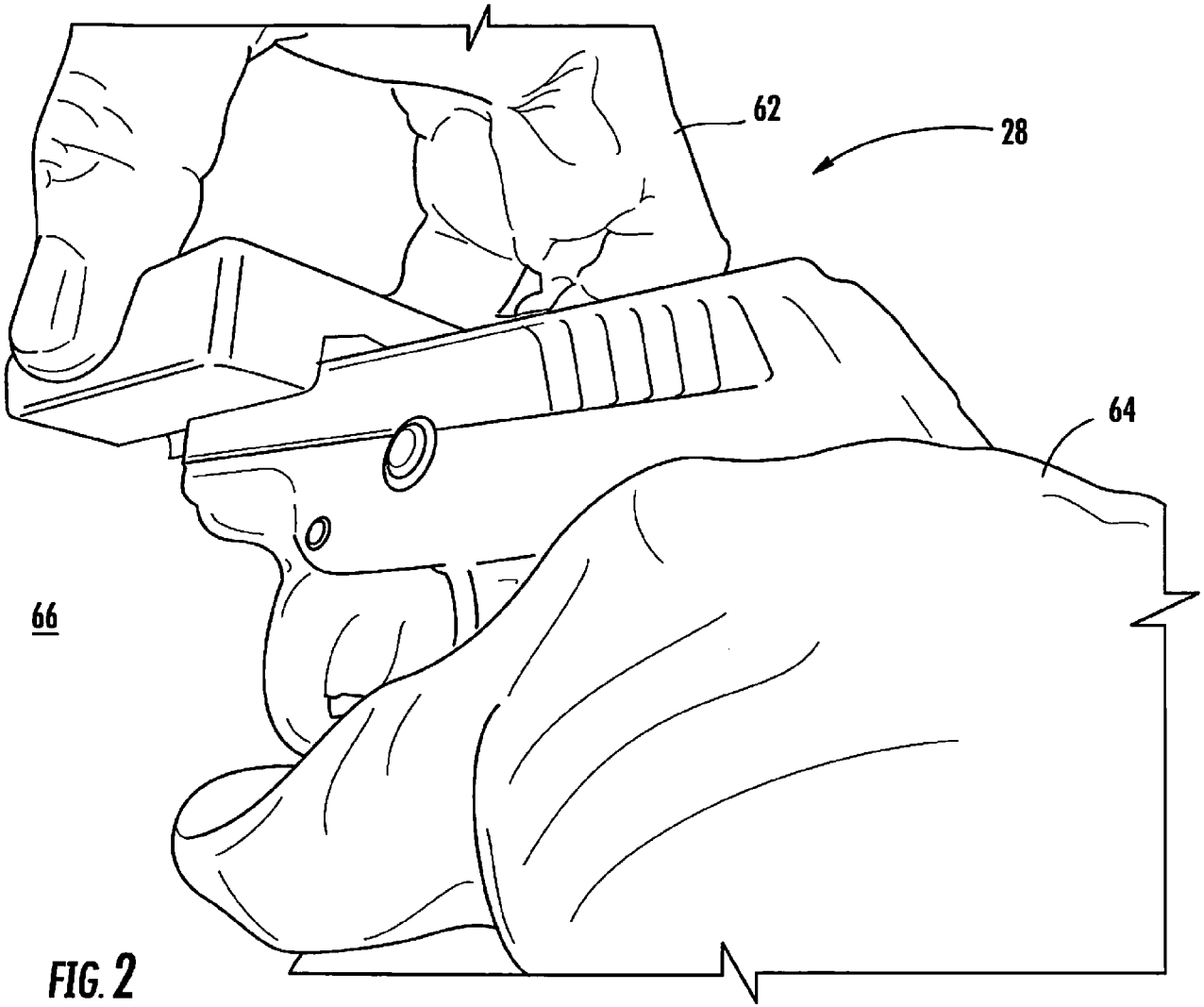
FIG. 2 illustrates a side elevation in partial cross-section of the handgun charging system of FIG. 1, shown placed against a hard surface and a user pressing on the grip of the handgun until a spent cartridge is ejected from the handgun.

The present subject matter relating to a system and method for charging a handgun is shown generally as (10) in FIG. 1. In the preferred embodiment, the handgun charging system is constructed of high-density polyethylene, but may be constructed of any desired plastic, wood, metal or other desired material. The handgun charging system (10) has a body (12), having a top face (14), a bottom face (16), a first side (18), a second side (20), a front face (22) and a rear face (24). Except for serrations and cavities, the faces are all preferably flat. The body (12) may be of any desired size or construction. In the preferred embodiment, the body is between 0.2 centimeters and 6.0 centimeters deep, more preferably, between 0.5 centimeters and 3.0 centimeters deep and, most preferably, between 1.0 and 2.0 centimeters deep. In the preferred embodiment, the body is between 2.0 and 10.0 centimeters in width, more preferably between 3.0 and 6.0 centimeters in width and, most preferably, between 4.0 and 5.0 centimeters in width. In the preferred embodiment the body is between 4.0 and 40.0 centimeters in length, more preferably between 5.0 and 15.0 centimeters in length and, most preferably, between 6.0 and 8.0 centimeters in length. Molded, or otherwise provided in the first side (18) and second side (20) of the body (12) are a plurality of angled serrations (26) that allow the body (12) to be more easily gripped by a user (28). (FIGS. 1-2.)

Provided in the bottom face (16) of the body (12) is a first cavity (30) in open communication with a second cavity (32). The first cavity (30) is a first sidewall (34) defining a slide receiver (36). As shown in FIG. 1, the slide receiver (36) defines a first longitudinal length and a first width, wherein the first longitudinal length is longer than the first width. The slide receiver (36) opens to the bottom face (16) and the rear face (24) of the body (12). The second cavity (32) is a second sidewall (38) defining a slot (40). As shown, the slot defines a second longitudinal length, wherein the second longitudinal length is longer than the second width. The slot (40) preferably opens to the bottom face (16) and front face (22) of the body (12), but may open to one or neither. The first sidewall (34) is preferably provided with dimensions similar to the dimensions of the front of the slide (42) of the handgun (44). The handgun (44) may be of any type known in the art, but is preferably an automatic or semi-automatic handgun having the slide (42) provided around a barrel (46) and coupled to a frame (48), which includes a grip (50) and a trigger guard (52). Provided within the trigger guard (52) is a trigger assembly (54). The size and configuration of the body (12) and cavities (30) and (32) will depend upon the dimensions of the slide (42) used in association with the body (12). Preferably, the cavities (30) and (32) are large enough to allow the slide (42) to be laterally engaged to the body (12) without having to move the slide (42) forward relative to the body (12) to frictionally engage the body (12).

As shown in FIG. 1, the first sidewall (34) is sized to accommodate and frictionally fit into mating engagement with the top of the slide (42). Preferably, the handgun charging system (10) is specifically constructed to work with a particular handgun (44) or model of handguns (44) having similarly constructed slides (42). As shown in FIG. 1, the first sidewall (34) may be provided with an additional recess (56) either running the length of the first sidewall, or positioned along the first sidewall (34) near the second cavity (32) to accommodate the front site (58) of the handgun (44).

The first cavity (30) is deeper and wider than the second cavity (32), forming a wall (60) between the first cavity (30) and second cavity (32). The wall (60) acts as a slide stop to prevent the slide (42) of the handgun (44) from sliding forward from the first cavity (30) into the second cavity (32) along with the barrel (46). As shown in FIGS. 1 and 2, when it is desired to charge or unload the handgun (44), the body (12) is positioned over the handgun (44) in a manner in which the slide (42) of the handgun (44) is frictionally fit into engagement with the slide receiver (36). The user then grips the serrations (26) of the body (12), preferably with the user's off hand (62), and grips the grip (50) of the handgun (44) with the user's strong hand (64). (FIGS. 1-2). The user (28) then places the front face (22) of the body (12) against a hard surface (66), such as a table, wall, door or the ground.

As shown in FIG. 2, to charge the handgun (44) the user (28) places the body (12) of the handgun charging system (10) with one hand (62) against the hard surface (66) while using the other hand (64) to press downward on the grip (60) of the handgun (44). As the user (28) continues to apply downward pressure to the grip (50), the wall (60) between the first cavity (30) and second cavity (32) engages the slide (42), causing the slide (42) to be held in place relative to the body (12) as the frame (48) and barrel (46) continue to move downward toward the hard surface (66). As the user (28) continues to apply downward force to the grip (50), the barrel (46) extends into the second cavity (32). As shown in FIG. 1, the second cavity (32) is preferably larger than the barrel (46) to allow the barrel (46) to extend into the second cavity (32) without contacting the sides of the second sidewall (38).

Figure 3:
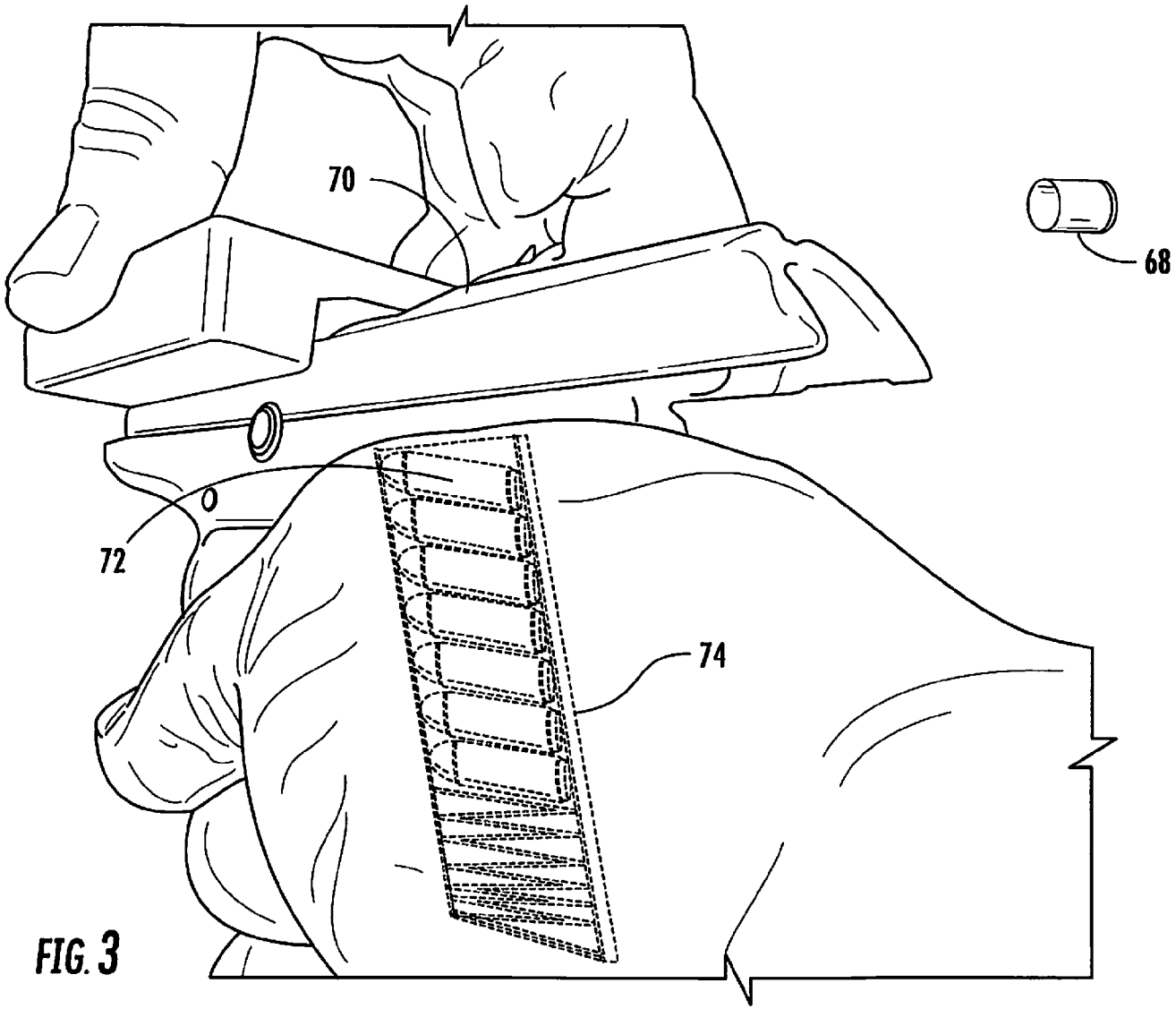
FIG. 3 illustrates a side elevation in partial cross-section of the handgun charging system of FIG. 1, shown with the user releasing pressure on the grip and the slide racking a cartridge into the barrel.
Figure 4:
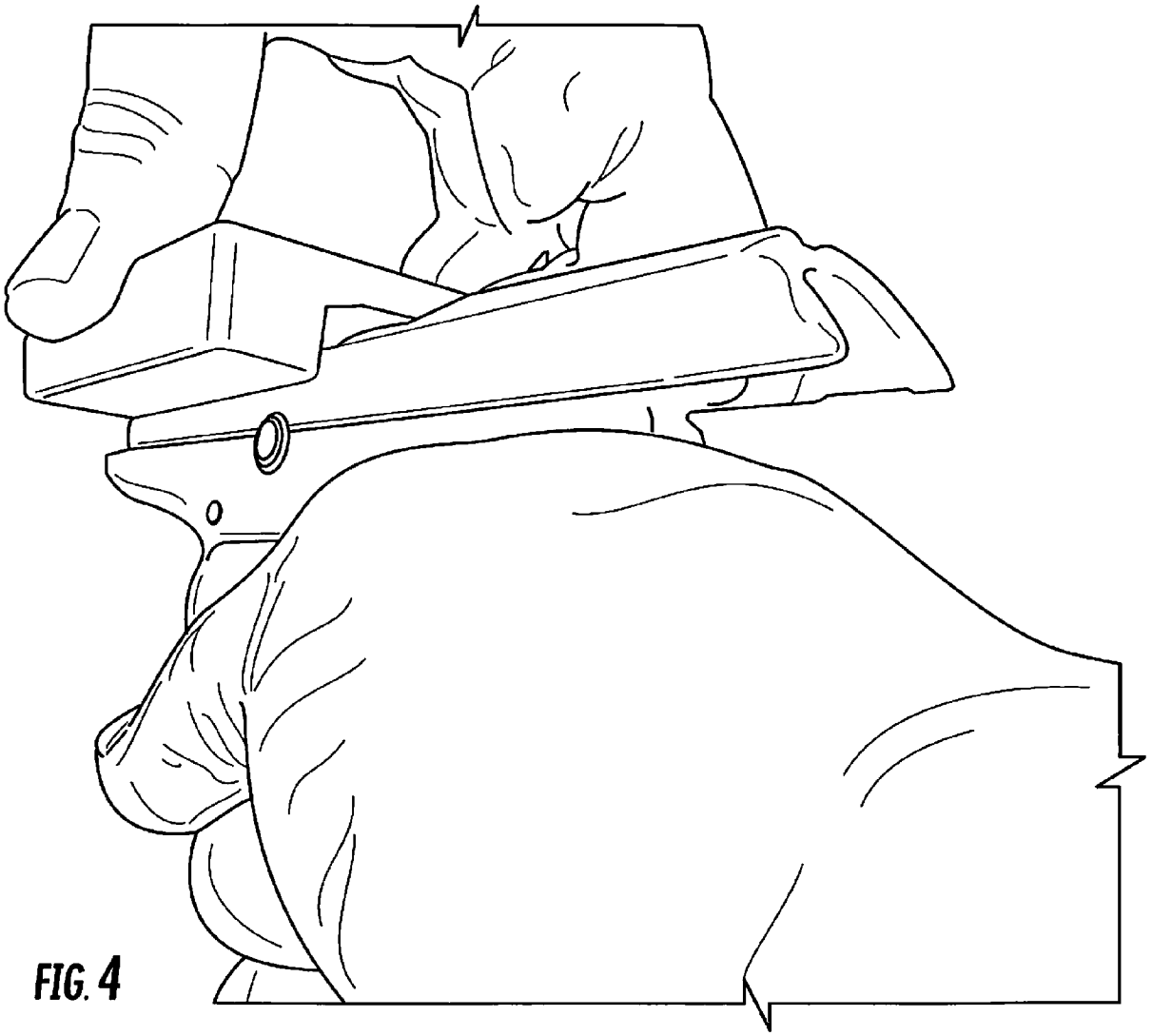
FIG. 4 illustrates a side elevation in partial cross-section of the handgun charging system of FIG. 1, shown with the user releasing downward pressure on the grip and the slide being returned to battery.

As shown in FIGS. 1 and 3, as the frame (48) and barrel (46) move downward relative to the slide (42), an ejector (not shown), such as those known in the art, coupled to the slide (42) catches a spent shell casing (68) and ejects the spent shell casing (68) through the ejection port (70) of the handgun (44). Once the shell casing (68) has been ejected, the user (28) releases pressure on the grip (50), allowing the recoil spring (not shown), such as those known in the art, coupled to the slide (42) to retract the grip (50) toward the slide (42). As the slide (42) moves forward relative to the frame (48), the slide (42) engages the next cartridge (72) in the magazine (74) provided in the grip (50), strips the cartridge (72) from the magazine (74) and inserts the cartridge (72) into the barrel (46) of the handgun (44). As shown in FIG. 4, once downward pressure on the grip (50) is released, the slide (42) is returned to battery, the handgun (44) is fully charged and the body (12) may be removed from the slide (42). If desired, the body (12) may be used to empty the handgun (44) of ammunition by removing the magazine (74) from the grip (50) and performing the charging operation described above.

Figure 5:
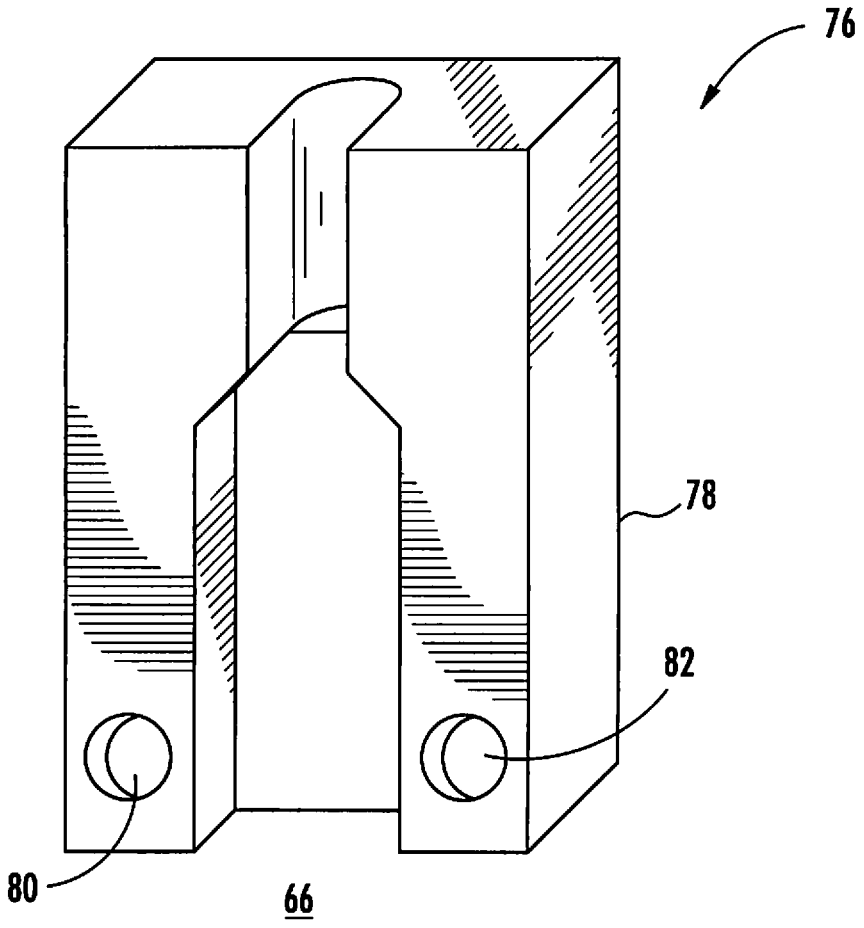
FIG. 5 illustrates a bottom perspective view of an alternative embodiment of the present invention, shown with finger holes.

An alternative embodiment of the present invention is shown generally as (76) in FIG. 5. As shown, the body (78) is provided with a first finger hole (80) and second finger hole (82) to allow a user to pull the body (78) rearward against a handgun if it is not desired to place the body (78) against a hard surface (66) for charging.

Figure 6:
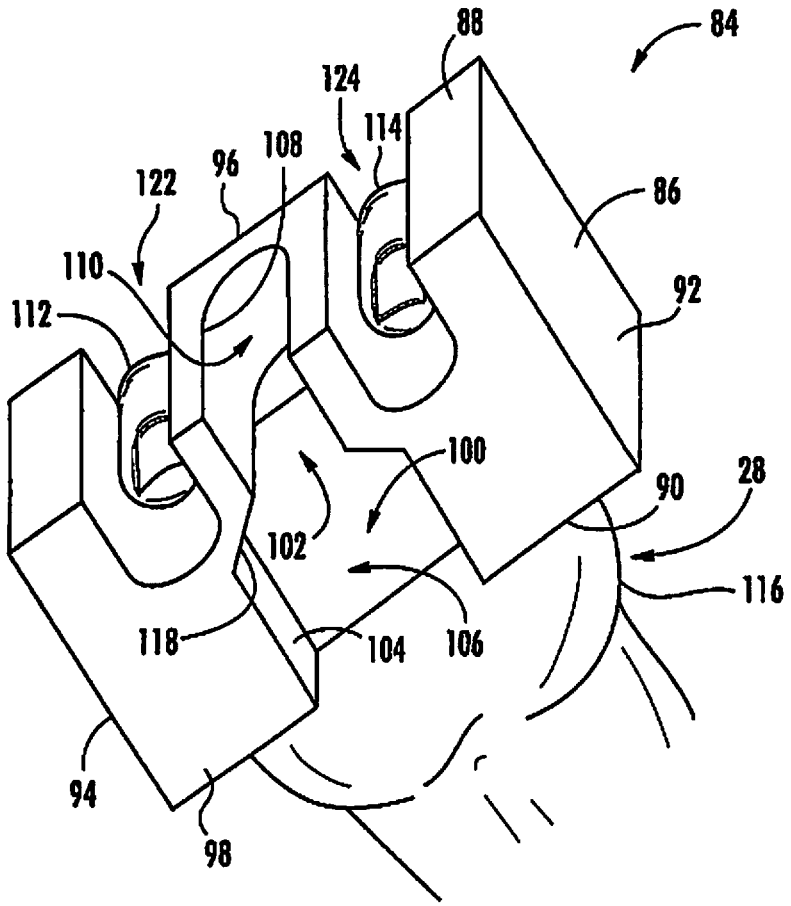
FIG. 6 illustrates a side elevation in partial cross-section of an alternative embodiment of the handgun charging system of the present invention.

Yet another alternative embodiment is shown generally as (84) in FIG. 6. As shown, the body (86) has a front face (88) and rear face (90) longer than a first side (92) and second side (94). The body (86) also has a top face (96) and a bottom face (98). Provided in the bottom face (98) of the body (86) are a first cavity (100) and a second cavity (102). The first cavity (100) is a first sidewall (104), defining a slide receiver (106). The slide receiver (106) may have a length, as measured from front to back, greater than its width, as measured from side to side. The slide receiver (106) opens to the bottom face (98) and rear face (90) of the body (86).

The second cavity (102) is a second sidewall (108) defining a slot (110). The slot (110) may have a length, as measured from front to back, greater than its width, as measured from side to side. The slot (110) is preferably provided with a length and width less than the length and width of the slide receiver (106). As the slot (108) is preferably shorter than the travel required by the slide to charge the handgun (44), the slot (108) preferably opens to the front face (88) of the body (84). The slot (110) preferably opens to the bottom face (98) of the body (84), but may, if desired, open only to the slide receiver (106) and front face (88) of the body (84).

To use the body (84) to charge a handgun (44), the slide receiver (106) is frictionally fit over the slide (42) of the handgun (44), the slide receiver (106) being sized to accommodate the particular slide (42). As the slot (110) is preferably shorter than the travel required by the slide to charge the handgun (44), instead of placing the front face (88) of the body (84) on a hard surface, the user (28) wraps two fingers (112) and (114) of the one hand (62) around the front face (88) of the body (84), maintaining downward pressure on the top face (96) of the body (84) with the palm (116) of the hand (62). The user (28) wraps the other hand (64) around the grip (60) of the handgun (44). The user (28) moves the body (84) and the grip (60) toward one another, causing the wall (118) between the first cavity (100) and second cavity (102) to engage the slide (42), as the barrel (46) moves through the slot (108) and extends therefrom a sufficient distance to allow the slide (42) to engage the next cartridge (120) as the user (28) releases pressure on the body (84) and the recoil spring (not shown) is allowed to return the slide (42) to battery. The body (84) may be of any suitable dimensions, and may be provided with holes (not shown) or scallops (122) and (124) to accommodate the user's fingers (112) and (114).

Although the invention has been described with respect to a preferred embodiment thereof, it is to be understood that it is not to be so limited since changes and modifications can be made therein which are within the full, intended scope of this invention as defined by the appended claims.

What is claimed is:

1. A charger for a handgun having a line of fire comprising a barrel having a muzzle, a slide and a frame, the charger comprising:

a nonhuman body comprising a bottom face;

a first sidewall defining a slide receiver in the bottom face of the body;

a second sidewall defining a slot in the body in open communication with the slide receiver;

wherein the slot is sufficiently unobstructed so as to allow the charger to be placed on and removed from the muzzle end of the slide, without placing the charger in the line of fire; and a slide stop provided on the body.

2. The handgun charger of claim 1 wherein the body further comprises:

(a) a top face;

(b) a first side;

(c) a second side;

(d) a front face; and (e) a rear face.

3. The handgun charger of claim 2, wherein the slot defines an opening in the bottom face of the body.

4. The handgun charger of claim 3, wherein the slide receiver defines an opening in the rear face of the body.

5. The handgun charger of claim 4, wherein the slot defines an opening in the front face of the body.

6. The handgun charger of claim 5, wherein the slide stop is located between the slide receiver and the slot.

7. The handgun charger of claim 6, wherein the slide receiver is wider than the slot.

8. The handgun charger of claim 7, wherein the front face is substantially flat.

9. The handgun charger of claim 2, further comprising a first set of serrations provided on the first side of the body and a second set of serrations provided on the second side of the body.

* * * * *